United States Patent [19]

Weaver

[11] Patent Number: 4,607,786

[45] Date of Patent: Aug. 26, 1986

[54] DOUBLE INSERT LOCK CARTON AND BLANK THEREFOR

[75] Inventor: Sherry M. Weaver, Chicago, Ill.

[73] Assignee: Waldorf Corporation, St. Paul, Minn.

[21] Appl. No.: 712,714

[22] Filed: Mar. 18, 1985

[51] Int. Cl.[4] ..... B65D 5/08

[52] U.S. Cl. ..... 229/45 R; 229/117; 229/138; 229/149

[58] Field of Search ..... 229/44 R, 45 R, 36, 229/38, 33, 39 R, 40

[56] References Cited

U.S. PATENT DOCUMENTS

| | | | |
|---|---|---|---|
| 164,099 | 6/1875 | Moore | 229/39 R |
| 399,891 | 3/1889 | Harley | 229/35 |
| 414,450 | 11/1889 | Schwartz | 229/45 R |
| 1,104,821 | 7/1914 | Morrison | 229/36 |
| 1,823,710 | 9/1931 | Thompson | 229/39 R |
| 2,060,240 | 11/1936 | Pergande | 229/155 |
| 2,316,362 | 4/1943 | Poe | 229/45 R |
| 2,572,159 | 10/1951 | Kells et al. | 229/45 R |
| 2,822,917 | 2/1958 | Toensmeier | 229/112 |
| 3,261,537 | 7/1966 | Kistner | 229/45 R |
| 3,690,543 | 9/1972 | Zeitter | 229/117 |

FOREIGN PATENT DOCUMENTS

| | | | |
|---|---|---|---|
| 695664 | 10/1964 | Canada | 229/40 |
| 2924302 | 12/1980 | Fed. Rep. of Germany | 229/38 |
| 2417438 | 10/1979 | France | 229/45 R |
| 248674 | 3/1926 | United Kingdom | 229/45 R |
| 1044993 | 10/1966 | United Kingdom | 229/39 R |

*Primary Examiner*—George E. Lowrance
*Assistant Examiner*—Gary E. Elkins
*Attorney, Agent, or Firm*—Dorsey & Whitney

[57] ABSTRACT

A paperboard blank and carton are provided with a securely and redundantly lockable closure. The front panel of the carton formed from the blank includes an aperture extending therethrough and at least one locking cut line. A top panel is hingedly moveable between an opened and a closed condition. A front flap articulated to the top panel in turn includes a locking tab and a locking flap. The locking tab engages the aperture in the front panel, while the locking flap engages the locking cut line.

15 Claims, 6 Drawing Figures

DOUBLE INSERT LOCK CARTON AND BLANK THEREFOR

BACKGROUND OF THE INVENTION

Paperboard cartons often are used to store articles that are easily broken, contaminated or otherwise subject to damage. Typically the carton will be constructed to properly retain and support the article therein. However, it also is necessary to insure that the carton is securely closeable to prevent the article from falling out. This is particularly important where the carton is likely to be moved while the article is stored therein.

In many instances the secure closure of the carton is insured by an adhesive, such as glue or tape, or by a separate plastic overwrap completely enveloping the carton. Although these types of secure closures typically are quite functional, they invariably require additional manufacturing steps, and can add to the cost of the carton. More particularly the equipment needed to securely close or overwrap often is not available to the manufacturer of the articles to be stored in the carton. Thus, the manufacturer of the articles to be stored in the carton may have to invest in expensive packaging equipment of limited application in the principal business of that manufacturer. Alternatively the product manufacturer may have to subcontract for the packaging of its manufactured products. This latter option often is undesirable since it may require an initial shipping of improperly packaged articles, and can reduce the direct control that the manufacturer has over its product. Additionally, in certain environments, the use of plastic tapes or overwraps is undesirable because plastic materials can create static electricity when moved relative to one another. Adhesives and overwraps are further undesirable in that they can fail or be tampered with thereby rendering the carton insecure. Furthermore, adhesives and overwraps may provide a secure initial closure of a carton, but can provide a much less secure reclosure.

For the reasons explained above, purely mechanical closures often are considered to offer several advantages. Specifically, mechanical closures can minimize the manufacturing steps and costs, and can provide for secure reclosures. Furthermore mechanical closure often can be completed without specialized equipment. However, prior art mechanical closures of cartons have often been less secure than closures relying upon adhesives and/or overwraps.

The typical prior art mechanical closure has relied upon an interengagement of locking tabs and slots. More particularly, a closure panel typically would be hingedly attached to a side wall of a carton and adapted to rotate into a position to cover an opening in the carton. A locking tab or flap would be hingedly attached to the closure panel of the prior art carton, and would be adapted to be inserted into a corresponding slot in an adjacent side wall of the carton. In certain constructions, the locking tab or flap would include at least one locking cut line dimensioned and located to be substantially in line with the slot in the carton side wall. These adjacent arrays of cut lines and/or slots would enable an edge of the locking flap defined by the locking cut line therein to abut an edge formed by the slot in the side wall. This edge-to-edge abutment is intended to minimize the possiblity of inadvertent disengagement of the locking flap from the side wall slot. Several variations of this general locking tab construction are well known, such as the particular construction shown in the bottom wall of the carton described in U.S. Pat. No. 3,163,321 which issued to Weiss on Dec. 29, 1964.

Despite several positive features of the above described prior art cartons, it is considered desirable to provide a carton with significantly enhanced locking ability.

In view of the above it is an object of the subject invention to provide a carton that can be securely locked into a closed condition without adhesives or overwraps.

It is another object of the subject invention to provide a paperboard carton that can be securely locked entirely by an interengaged array of locking flaps or tabs.

It is an additional object of the subject invention to provide a carton with a double insert locking flap or tab construction.

It is a further object of the subject invention to provide a carton with a redundant array of locking flaps or tabs for insuring secure positive closure thereof.

It is still another object of the subject invention to provide a securely locked carton that can be easily opened and readily reclosed.

It is still a further object of the subject invention to provide a carton that will show evidence of tampering.

Another object of the subject invention is to provide a carton that can be placed in a collapsed or knocked down condition and then easily erected for packing and secure mechanical locking without specialized equipment.

SUMMARY OF THE INVENTION

The carton of the subject invention can be formed from a single blank of paperboard material and preferably a single blank of corrugated paperboard material. The blank includes a rectangular first side panel, a rectangular rear panel, a rectangular second side panel and a rectangular front panel consecutively articulated to one another along parallel fold lines. The first side panel, rear panel, second side panel and front panel are provided respectively with bottom flaps that can be interengaged on the erected panel to provide a secure closure. The bottom flaps are constructed to facilitate collapsibility of a partly formed carton as explained further below.

The front panel of the blank includes a top edge opposite the bottom flap thereof. The front panel also is characterized by at least one locking cut line and by an aperture which is disposed intermediate the locking cut line and the top edge of the front panel. Preferably the locking cut line is adjacent the aperture in the front panel. In a particularly preferred embodiment as described further below, the locking cut line is generally collinear with an edge of the aperture in the front panel, and defines the portion of said aperture most distant from the top edge of said front panel.

A generally rectangular top panel is articulated to the rear panel along a fold line extending generally parallel to the foldable connection between the rear panel and the bottom flap attached thereto. Preferably pairs of articulated triangular connecting panels extend between and connect the side panels of the blank to the top panel thereof.

A front flap is articulated to the top panel along a fold line extending generally parallel to the foldable connection between the top and rear panels. A locking flap characterized by at least one locking edge is connected to the front flap. More particularly, the distance between the locking edge of said locking flap and the top panel is substantially equal to the distance between the top edge of said front panel and the locking cut line formed therein. Preferably a connecting flap is defined in the blank intermediate the front and locking flaps.

The front flap is further characterzied by a cut line or array of cut lines extending generally convexly toward the top panel. More particularly, the convex cut line or array of cut lines terminate at points that are nearer to the locking flap than they are to the top panel, and that preferably are adjacent the connecting flap. The cut line or array of cut lines in the front flap effectively defines a locking tab. The distances between the top panel and the respective termini of the arcuate cut line or array of cut lines in the front flap substantially corresponds to the distance between the top edge of the front panel and the aperture therein. Stated differently the distance between the top panel and the locking tab is less than the distance between the top edge of the front panel and the aperture therein.

The carton can be formed by rotating the first side panel, rear panel, second side panel and front panel around the respective fold lines therebetween to form a tubular rectangular structure. This partially formed carton then can be collapsed and shipped to another location for subsequent packing. At this packing location, the flattened partially formed carton can be erected into a generally rectangular tubular condition. As explained further below, the construction of the bottom flaps can be such as to cause the bottom end of the carton to be automatically locked into a closed condition as the flattened carton is urged into the rectangular tubular form. In this partly erected condition, the article to be packed then can be inserted into the carton.

The carton is securely closed by rotating the top panel about its hinged connection to the rear panel and toward the front panel. As the top panel is rotated toward the front panel, the locking flap is inserted into the locking cut line formed in the front panel. Prior to complete insertion of the locking flap through the locking cut line in the front panel, the locking tab is urged out of the plane of the front flap and toward the front panel. The locking tab then can be inserted into the aperture formed in the front panel. The front flap then is urged into face-to-face contact with the front panel, thereby causing the locking flap and the locking tab to be inserted substantially entirely into the carton. In this completely closed condition, the locking edge of the locking flap will engage the edges formed by the locking cut line in the front panel. Additionally, the locking tab will securely and lockingly engage the upper edge of the aperture in the front panel. Thus, the carton will be securely and redundantly locked by both the locking flap and the locking tab. This double locking will substantially prevent inadvertent opening. Intentional opening of the carton is facilitated in embodiments where the fold line between the front and connecting panels are formed with alternating cut and score lines. Thus, the front flap can be severed from the connecting flap enabling the carton to be easily opened.

DETAILED DESCRIPTION OF THE PREFERRED EMBODIMENT

Figure 1:
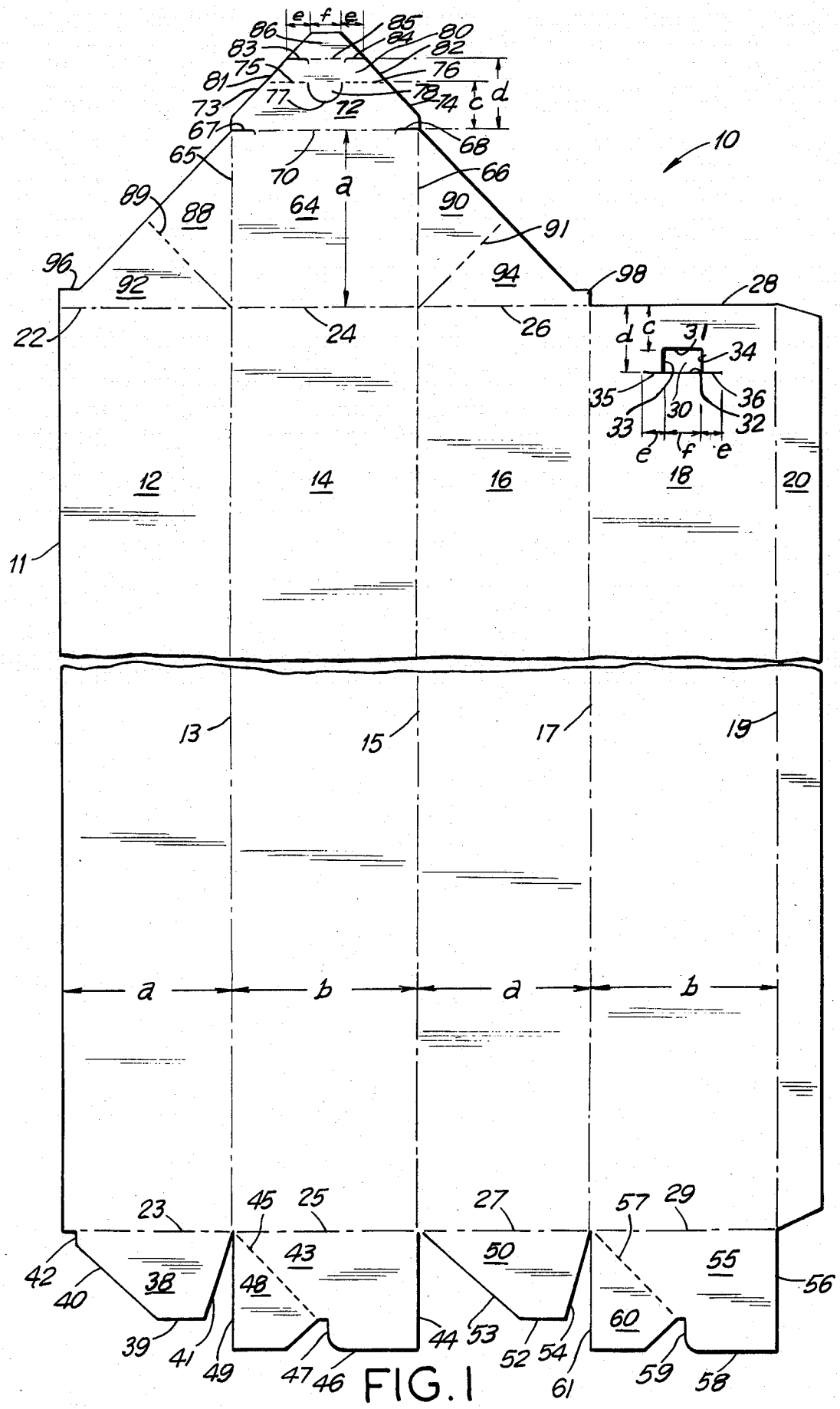
FIG. 1 is a plan view of the blank of the subject invention.

The blank of the subject invention is indicated generally by the numeral 10 in FIG. 1. The blank 10 is formed from a single sheet of corrugated paperboard material. More particularly, the blank 10 includes rectangular first side panel 12, rectangular rear panel 14, rectangular second side panel 16, rectangular front panel 18 and glue flap 20 which are articulated to one another along parallel fold lines 13, 15, 17 and 19 respectively.

The first side panel 12 is further defined by edge 11 which is parallel to fold line 13, and by fold lines 22 and 23, which are parallel to one another and extend between edge 11 and fold line 13.

The rear panel 14 is further defined by fold lines 24 and 25 which are parallel to one another and are collinear respectively with fold lines 22 and 23.

The second side panel 16 is further defined by fold lines 26 and 27 which are parallel to one another and collinear respectively with fold lines 24 and 25. Fold lines 22, 23, 26 and 27 all are of substantially equal length as indicated by dimension "a" in FIG. 1.

The front panel 18 is further defined by edge 28 and fold line 29, which are parallel to one another and extend collinearly from fold lines 26 and 27 respectively. Fold lines 24, 25 and 29 and edge 28 all are of substantially equal length as indicated by dimension "b" in FIG. 1.

The front panel 18 is further defined by aperture 30 which is of generally rectangular configuration. More particularly, aperture 30 is defined by upper edge 31 and lower edge 32 which are generally parallel to one another and to edge 28 of front panel 18. Aperture 30 is further defined by side edges 33 and 34 which are parallel to one another, and are aligned perpendicular to the upper edge 31. Cut lines 35 and 36 extend generally co-linearly away from the opposed ends of edge 32. Preferably the upper edge 31 of aperture 30 is spaced from top edge 28 of front panel 18 a distance of at least approximately 1 inch as indicated by dimension "c" in FIG. 1. Cut lines 35 and 36 preferably are spaced from edge 28 at least approximately 1.5 inches, as indicated by dimension "d". The cut line 35 and 36 each are preferably of at least approximately ⅜ inch long as indicated by dimension "e".

The bottom portion of the carton blank 10 is of the conventional construction and no novelty is being claimed therein.

As can be seen from FIG. 1, trapezoidal bottom flap 38 is articulated to the first side panel 12 along fold line 23. More particularly, the bottom flap 38 includes edge 39 which is generally parallel to but shorter than fold line 23, and by nonparallel edges 40 and 41. Edge 40 is aligned at approximately a 45° angle to fold line 23, but is characterized by notch 42 adjacent to fold line 23 to facilitate the overlapping arrangement of flaps on the carton erected from blank 10.

Bottom flap 43 is articulated to the rear panel 14 along fold line 25. Bottom flap 43 is further defined by edge 44 which extends co-linearly from fold line 15 and by fold line 45 which intersects fold line 25 at approximately a 45° angle. Edge 46 of bottom flap 43 extends perpendicularly from edge 44 thereof. Bottom flap 43 is further defined by locking notch 47. Glue tab 48 is articulated to the bottom flap 43 along fold line 45. Glue tab 48 is further defined by edge 49 which extends generally co-linearly from fold line 13.

Trapezoidal bottom flap 50 is foldably connected to the second side panel 16 along fold line 27. The bottom flap 50 is further defined by edge 51 which is parallel to but shorter than fold line 27 and by nonparallel edges 53 and 54. Edge 53 intersects fold line 27 at approximately a 45° angle.

The bottom flap 55 is articulated to the front panel 18 along fold line 29, and is substantially identical to bottom flap 43. The bottom flap 55 is further defined by edge 56 which extends co-linearly from fold line 19, and by fold line 57 which intersects fold line 29 at approximately a 45° angle. The bottom flap 55 is further defined by edge 58 which extends perpendicularly from edge 56 and by notch 59 which will interlock with notch 47 on the carton erected from blank 10.

Glue tab 60 is articulated to the bottom flap 55 along fold line 57. The glue tab 60 includes edge 61 which extends generally co-linearly from fold line 17.

Top panel 64 is articulated to the rear panel 14 along fold line 24. Top panel 64 is generally rectangular and is defined in part by parallel fold lines 65 and 66 which extend co-linearly from the ends of fold lines 13 and 15 respectively. The fold lines 65 and 66 are substantially equal in length to fold lines 22, 23, 26 and 27 as indicated by dimension "a" in FIG. 1. The top panel 64 is further defined by cut lines 67 and 68 which extend a short distance toward one another from the ends of fold lines 65 and 66 respectively most distant from fold line 24. Fold line 70 effectively joins cut lines 67 and 68 such that cut lines 67 and 68 and fold line 70 extend along along lines which are slightly apart and parallel to fold line 24 so as to assist in the reclosing of the carton.

Front flap 72 is articulated to the top panel 64 along fold line 70. The front flap 72 is of generally trapezoidal configuration and is further defined by edges 67 and 68 which together with fold line 70 define the base of the generally trapezoidal front flap 72. The front flap 72 is further defined by edges 73 and 74 which converge toward one another. The side of the generally trapezoidal front flap 72 opposite the base thereof is defined by fold lines 75 and 76 which extend toward one another from edges 73 and 74 and generally parallel to fold line 70. Fold lines 75 and 76 lie along a common line but do not directly meet. Rather, fold lines 75 and 76 are joined by arcuate cut line 77 which has its convex side toward fold line 70. The arcuate cut line 77 defines locking tab 78. The distance between the opposed termini of arcuate cut line 77, as indicated by dimension "f" is slightly smaller than the length of upper edge 31 of the aperture 50 in front panel 18. Preferably fold lines 75 and 76 are defined by alternating cut and score lines.

Connecting flap 80 is articulated to the front flap 72 along fold lines 75 and 76. The connecting flap 80 is further defined by edges 81 and 82 which are angled toward one another and extend from edges 73 and 74 of the front flap 72. Connecting flap 80 is further defined by cut line 83 and 84 which extend toward one another from edges 81 and 82 respectively. Cut lines 83 and 84 are joined by fold line 85. More particularly, cut lines 83 and 84 and fold line 85 are substantially collinear with one another. Locking flap 86 is articulated to the connecting flap 80 along fold line 85. The locking flap 86 is of generally trapezoidal configuration such that its base is defined by cut lines 83 and 84 and fold line 85. The distance between the locking tab 78 and the cut lines 83 and 84 is substantially equal to the length of edges 33 and 34 on aperture 30 in front panel 18. This ensures a secure double locking as explained below.

Triangular corner connecting panels 88 and 90 are articulated to the top panel 64 along fold lines 65 and 66 respectively. The corner connecting panel 88 is further defined by fold line 89 which extends from the intersection of fold lines 22 and 65 at approximately a 45° angle. Similarly the corner connecting panel 90 is further defined by fold line 91 which extends from the intersection of fold lines 26 and 66 at approximately a 45° angle.

Corner connecting panel 92 is articulated to the corner connecting panel 88 along fold line 89 and is articulated to the first side panel 12 along fold line 22. Similarly the corner connecting panel 94 is articulated to corner connecting panel 90 along fold line 91, and is articulated to the second side panel 16 along fold line 26. Connecting panels 92 and 94 are of generally triangular configuration but are characterized by locking protrusions 96 and 98 respectively.

The blank 10 shown in FIG. 1 can be formed directly into the erected carton shown in FIGS. 2 through 6, or can be formed initially into a collapsed structure that can be erected at a later time. More particularly, the blank 10 is formed into a collapsed structure by first rotating the bottom flaps 38, 43, 50 and 55, 180° about fold lines 23, 25, 27 and 29 respectively. The glue tabs 48 and 60 then are rotated 180° back about fold lines 45 and 57 respectively so as to lie substantially in face-to-face contact with bottom flaps 43 and 55 respectively. The front panel 18 and the glue flap 20 then are rotated about fold line 17 to lie substantially in face-to-face contact with the second side panel 16 and a portion of the rear panel 14. The first side panel 12 then is rotated about fold line 13. In this folded and flattened condition, the portion of the first side panel 12 adjacent edge 11 thereof will lie in face to face contact with glue flap 20 such that edge 11 will be substantially adjcent fold line 19. Additionally, glue tab 60 will lie in face-to-face contact with bottom flap 50 with edge 61 being substantially adjacent fold line 27. Similarly glue tab 48 will lie in face-to-face contact with bottom flap 38 with edge 49 being substantially adjacent fold line 23. The glue flap 20 is adhered to the first side panel 12. Similarly, the glue tabs 48 and 60 are adhered to bottom flaps 38 and 50 respectively.

The above described flattened structure can be erected into the rectangular tubular form shown in FIGS. 2 through 6 by urging fold lines 13 and 17 toward one another. As the flattened structure assumes the shape of carton 100, the bottom flaps 38, 43, 50 and 55 will rotate downwardly about fold lines 23, 25, 27 and 29 respectively to form the bottom of carton 100. More particularly, the self-erecting bottom will be securely formed by the interlocking of notches 47 and 59.

Figure 2:
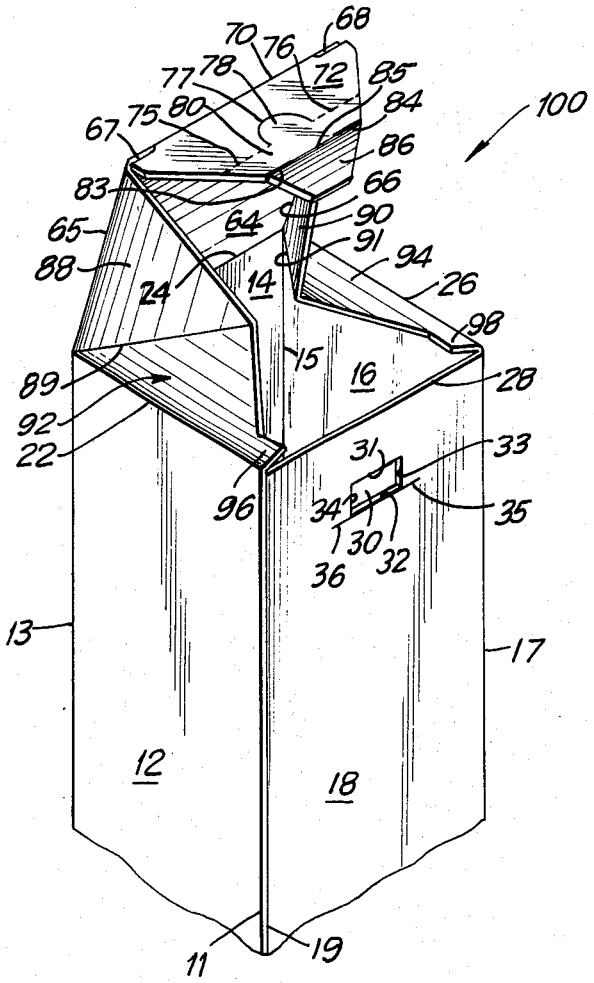
FIG. 2 is a perspective view of the erected, but opened, carton of the subject invention.
Figure 3:
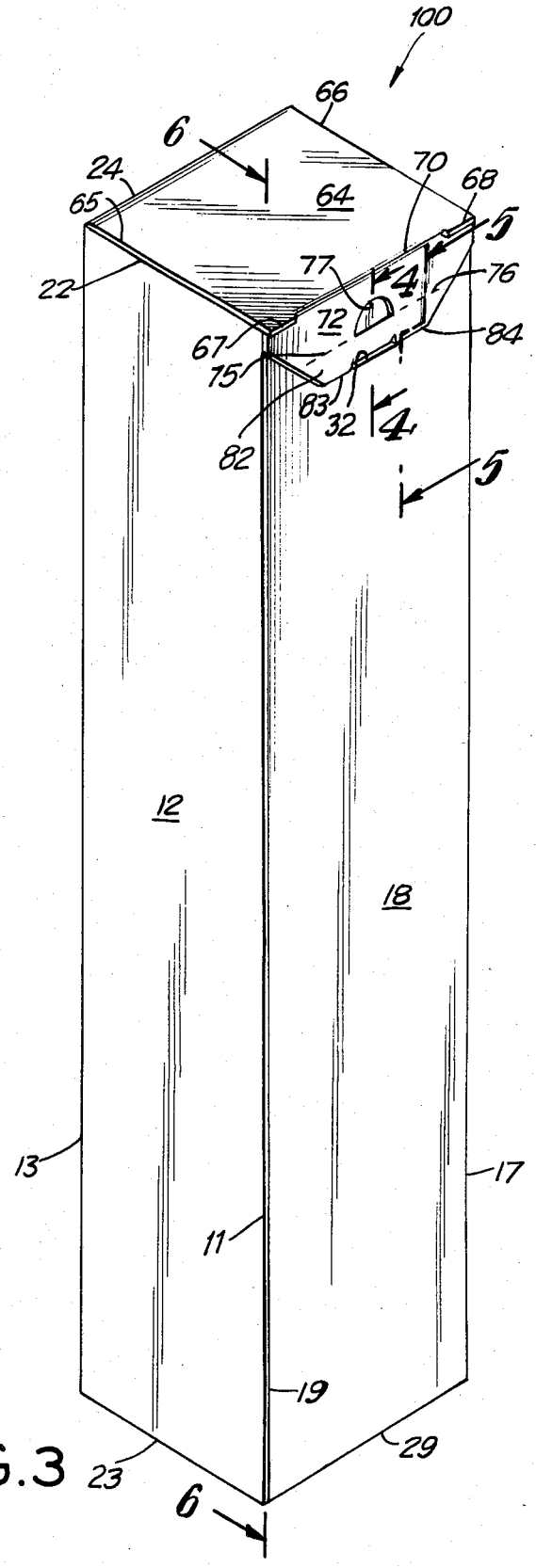
FIG. 3 is a perspective view of the locked carton of the subject invention.

The carton 100 can be erected as explained above and packed by the manufacturer of the product to be stored therein. After the carton has been completely packed, it can be securely closed and locked. More particularly, as shown in FIG. 2, the corner connecting panels 92 and 94 can be rotated toward one another about fold lines 22 and 26 respectively, while simultaneously rotating the top panel 64 about fold line 24. As the top panel 64 approaches the front panel 18, the locking tab 78 is urged out of the plane of the front panel 72 such that the locking tab 78 can engage the aperture 30. This insertion of locking tab 78 into the aperture 30 can be facilitated by rotating the connecting flap 80 about the fold lines 75 and 76. As the locking tab 78 is inserted into aperture 30, the locking flap 86 also is inserted into aperture 30 and through the slits formed by cut lines 35 and 36.

Figure 4:
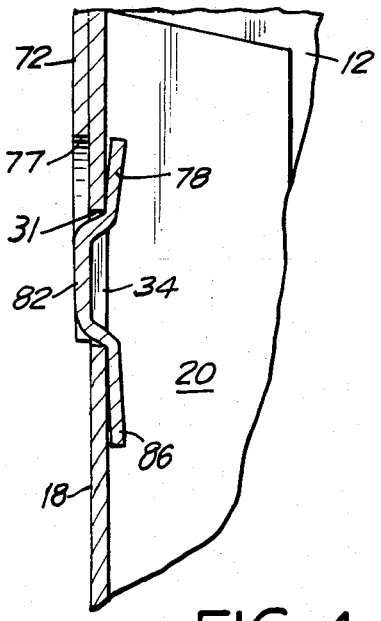
FIG. 4 is a cross-sectional view taken along line 4—4 in FIG. 3.
Figure 5:
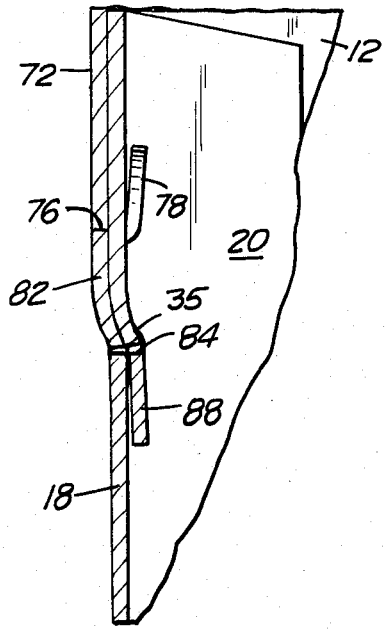
FIG. 5 is a cross-sectional view taken along line 5—5 in FIG. 3.
Figure 6:
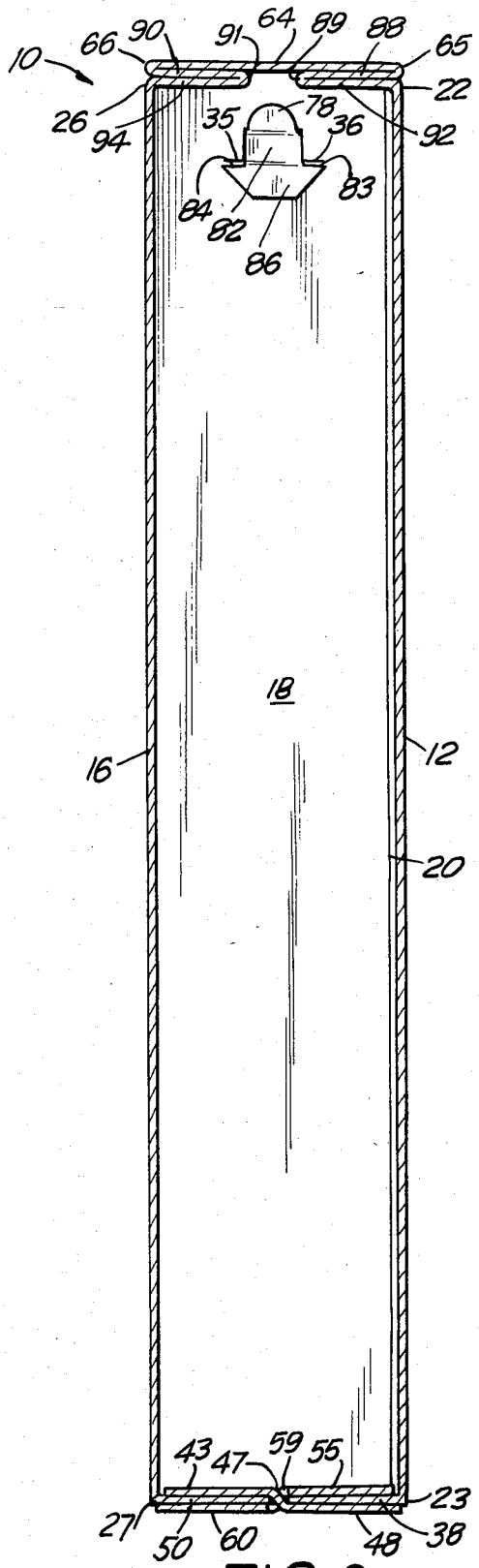
FIG. 6 is a cross-sectional view taken along line 6—6 in FIG. 3.

As illustrated most clearly in FIGS. 4 through 6, when the carton 100 is in its completely closed condition, the locking tab 78 will lie adjacent and in substantial face-to-face contact with the front panel 18, but on the inside of the carton 100. Additionally, the portion of locking tab 78 intermediate the score lines 75 and 76 will abut edge 31 of aperture 30 thereby locking the top panel 64 in a closed condition.

The carton 100 is more securely and redundantly locked in this closed condition by locking flap 86. More particularly, the insertion of locking tab 78 through aperture 30 will slightly deform the portion of front panel 18 adjacent aperture 30 and causing the edges 35 and 36 to be urged slightly inwardly. Edges 83 and 84 of the locking tab 86 will abut the edges 36 and 35 respectively, thereby redundantly locking the carton.

The closed carton 100, as shown most clearly in FIG. 6, can not accidently open. Additionally, the secure interlocking of tabs 78 and 86 with the front panel 18 of the carton makes a simple disengagement of locking tabs 78 and 86 extremely difficult. However, the carton 100 can be readily opened by severing the front panel 72 from the connecting panel 82 along cut/score lines 75 and 76. Thus, the front panel 72 and the top panel 64 can be rotated upwardly about fold line 24.

The opened carton 100 can be reclosed by rotating the top panel 64 about fold line 24 and into a closed condition. However, as the top panel 64 approaches the front panel 18, the front flap 72 is inserted interiorly of the front panel 18. When closed in this manner, edges 67 and 68 of the front flap 72 will be engaged by portions 96 and 98 respectively of the corner connecting panels 92 and 94 respectively. Thus, the reclosed carton 100 will not be inadvertently opened.

In summary, an improved blank and double locked carton is provided. The blank is formed from a single sheet of paperboard material. The blank includes rectangular first side panel, rear panel, second side panel, and front panel consecutively articulated to one another. Bottom flaps formed in the blank are configured to enable the carton to be collapsed and then easily and automatically erected. The front panel of the blank includes an aperture and a pair of locking cut lines adjacent the aperture. A top panel is articulated to the rear panel, a front flap, in turn, is articulated to the top panel. A locking tab is articulated to the front flap and is disposed to be engaged in the aperture in the front panel. Additionally a locking flap connected to the front flap is provided to engage the locking cut lines in the front panel. More particularly, on the carton erected from the blank the locking tab engages the aperture while the locking flap redundantly engages the locking cut lines in the front panel adjacent the aperture therein. The locking tab and the locking flap can easily be severed from the front flap to facilitate opening of the carton. The carton subsequently can be securely reclosed.

While the invention has been described with respect to a preferred embodiment, it is obvious that various changes can be made without departing from the spirit of the subject invention as defined by the appended claims.

What is claimed is:

1. A paperboard blank for forming a double lock carton, said blank comprising:

rectangular first side panel, rectangular rear panel, rectangular second side panel and rectangular front panel consecutively articulated to one another along parallel fold lines, said front panel including a top edge extending generally perpendicular to the fold line between said second side panel and said front panel, at least one locking cut line extending through said front panel and an aperture disposed in said front panel intermediate said cut line and said top edge;

bottom flaps articulated respectively to said first side panel, rear panel, second side panel and front panel along fold lines;

rectangular top panel being articulated to said rear panel along a fold line extending substantially parallel to the foldable connection between said rear panel and its respective bottom flap;

front flap articulated to said top panel along a fold line extending substantially parallel to the foldable connection of said top and rear panels;

a locking flap connected to said front flap, said locking flap including at least one locking edge spaced from said top panel a distance substantially equal to the distance between the top edge and the locking cut line in said front panel, said front flap including a locking tab defined by at least one cut line extending convexly toward said top panel, and being disposed such that the distance between said locking tab and said top panel is less than the distance between the top edge of said front panel and the aperture therein;

first and second pairs of generally triangular corner connecting panels foldably connected to said top panel and said first and second side panels respectively, the triangular corner connecting panels in each said pair being articulated to one another along fold lines which intersect the foldable connections of said rear panel to said top panel and each including a locking protrusion extending from the portion of said first and second corner connecting panels adjacent the first and second side panels respectively; and a pair of locking cut lines extending toward one another from the opposed ends of the foldable connection between said top panel and said front flap.

2. A paperboard blank for forming a double lock carton, said blank comprising:

rectangular first side panel, rectangular rear panel, rectangular second side panel and rectangular front panel consecutively articulated to one another along parallel fold lines, said front panel including a top edge extending generally perpendicular to the fold line between said second side panel and said front panel, at least one locking cut line extending through said front panel and an aperture disposed in said front panel intermediate said cut line and said top edge;

bottom flaps articulated respectively to said first side panel, rear panel, second side panel and front panel along fold lines;

rectangular top panel being articulated to said rear panel along a fold line extending substantially parallel to the foldable connection between said rear panel and its respective bottom flap; front flap articulated to said top panel along a fold line extending substantially parallel to the foldable connection of said top and rear panels; and a locking flap connected to said front flap, said locking flap including at least one locking edge formed by a cut line parallel to the locking cut line in said front panel and spaced from said top panel a distance substantially equal to the distance between the top edge and the locking cut line in said front panel, said front flap including a locking tab defined by at least one cut line extending convexly toward said top panel, and being disposed such that the distance between said locking tab and said top panel is less than the distance between the top edge of said front panel and the aperture therein.

3. A blank as in claim 2 wherein the locking cut line in said front panel is substantially parallel to the top edge thereof.

4. A blank as in claim 3 wherein the aperture in said front panel is generally rectangular, with a portion of the locking cut line in said front panel defining an edge of the rectangular aperture therein.

5. A blank as in claim 2 further including a connecting flap articulated to both said front flap and said locking flap and extending therebetween.

6. A blank as in claim 5 wherein the articulation between said front flap and said connecting flap defines a line of alternating cut and score lines.

7. A blank as in claim 2 including first and second pairs of generally triangular corner connecting panels foldably connected to said top panel and said first and second side panels respectively, the triangular corner connecting panels in each said pair being articulated to one another along fold lines which intersect the foldable connections of said rear panel to said top panel.

8. A blank as in claim 7 wherein the triangular corner connecting panels articulated respectively to said first and second side panels each includes a locking protrusion extending from the portion of said first and second corner connecting panels adjacent the first and second side panels respectively.

9. A blank as in claim 6 including a pair of locking edges extending collinearly from opposed ends of the foldable connection between the locking and connecting flaps.

10. A blank as in claim 4 wherein the distance between the locking cut line in said front panel and the edge of said aperture opposite the locking cut line is substantially equal to the distance between the locking tab and the locking edge of said locking flap.

11. A double locked carton formed from a single sheet of paperboard material, said carton comprising:

first and second generally rectangular side walls disposed in spaced parallel relationship;

generally rectangular front and rear walls foldably connected to and extending between said first and second side walls respectively;

generally rectangular top and bottom walls disposed in spaced parallel relationship and extending between said side walls and said front and rear walls, said top wall being articulated to said rear wall;

said front wall being characterized by a locking cut line and an aperture formed intermediate said locking cut line and said top wall;

a front flap articulated to said top wall and disposed in face-to-face contact with at least a portion of the front wall extending between said top wall and the locking cut line in said front wall, said front flap including a locking tab extending through the aperture in said front wall such that at least a portion of said locking tab is disposed in said carton and adjacent the portion of said front wall intermediate the aperture therein and the top wall of the carton; and a locking flap connected to said front flap, said locking flap being disposed within said carton adjacent the locking cut line in said front wall and having a locking edge substantially parallel to and engaging the locking cut line in said front wall.

12. A carton as in claim 11 wherein the aperture in said front wall is disposed adjacent the locking cut line therein.

13. A carton as in claim 11 wherein the locking cut line in said front wall is disposed substantially parallel to the top and bottom walls of the carton.

14. A carton as in claim 11 wherein the aperture in said front wall is generally rectangular.

15. A carton as in claim 11 wherein said locking cut line in said front wall comprises a pair of colinear locking cut line segments extending in opposite directions from said aperture and wherein said locking edge on said locking flap includes a pair of colinear locking edge segments engaging the locking cut lines.

* * * * *